US005722323A

United States Patent [19]

Whiting et al.

[11] Patent Number: 5,722,323

[45] Date of Patent: Mar. 3, 1998

[54] BLANKET CYLINDER THROW-OFF DEVICE

[75] Inventors: Frederick J. Whiting, LaGrange; Thomas W. Orzechowski, Orland Park; Stanley Momot, LaGrange; Thaddeus A. Niemiro, Lisle, all of Ill.

[73] Assignee: Goss Graphic Systems, Inc., Westmont, Ill.

[21] Appl. No.: 803,556

[22] Filed: Feb. 20, 1997

Related U.S. Application Data

[63] Continuation of Ser. No. 527,607, Sep. 13, 1995, abandoned.

[51] Int. Cl.[6] ..... B41F 13/24

[52] U.S. Cl. ..... 101/218; 101/247; 101/185

[58] Field of Search ..... 101/216, 218, 101/247, 375, 217, 143, 144, 145, 182, 184, 185, 192

[56] References Cited

U.S. PATENT DOCUMENTS

| | | | |
|---|---|---|---|
| 2,986,086 | 5/1961 | Siebke | 101/218 |
| 4,129,329 | 12/1978 | Longo | 294/70 |
| 4,362,098 | 12/1982 | Stelling, Jr. et al. | 101/247 |
| 4,643,090 | 2/1987 | McKrell et al. | 101/247 |
| 5,311,817 | 5/1994 | Funada | 101/247 |
| 5,445,076 | 8/1995 | Sugiyama et al. | 101/247 |

*Primary Examiner*—Ren Yan

*Attorney, Agent, or Firm*—Marshall, O'Toole, Gerstein, Murray & Borun

[57] ABSTRACT

An improved throw off device for disengaging adjacent blanket cylinders (12) and (14) from each other and corresponding adjacent plate cylinders (16) and (18) is provided. The device includes pairs of bearing assemblies (28A), (28B), (30A) and (30B) that are mounted on the opposite ends of the journal (26) of each of the blanket cylinders (12) and (14). Each bearing assembly is defined by an inner race (36) and an outer race (38) having an eccentric bore in which the inner race is disposed. The device eliminates the need for a bearing sleeve. Each bearing assembly has a lever (74) arm that is mounted to the outer race (38). The lever arm (74) is defined by two wing-shaped portions (76) and (78). Each bearing assembly further includes a hydraulic cylinder (86). Each hydraulic cylinder (86) is coupled at one end to one of the two wing-shaped portions of the lever arm (74) and at the other end to one of the side frames of the printing press. A stopping member (84) is mounted to the other wing-shaped portion of the lever arm (74). Each bearing assembly also has an corresponding adjustable stopping screw (88) that is mounted to the side frame adjacent to the stopping member (84). A plumbing circuit (100) is also provided for uniformly supplying each of the hydraulic cylinders with equal volumes of hydraulic fluid so that they engage and disengage the blanket cylinders (12) and (14) in tandem.

8 Claims, 6 Drawing Sheets

BLANKET CYLINDER THROW-OFF DEVICE

This is a Rule 62 file wrapper continuation of U.S. application Ser. No. 08/527,607, filed Sep. 13, 1995, now abandoned.

BACKGROUND OF THE INVENTION

1. Field of the Invention

This invention relates generally to offset printing presses and more particularly to such a printing press with a pair of blanket cylinders movably mounted by a throw off apparatus to enable separation from each other and a pair of plate cylinders.

2. Background Art

Typical offset printing presses are defined by one or more printing units. Each printing unit includes a pair of substantially identical plate cylinders mounted for rotation about fixed axes of rotation. Each of the plate cylinders has a printing plate mounted on its outer circumferential surface which carries an image to be printed on a web of paper passing between a pair of blanket cylinders disposed adjacent to the pair of plate cylinders. Each of the blanket cylinders carries a cylindrical printing blanket which is mounted to its outer circumferential surface.

The images carried on the printing plates are transferred as inked images to the cylindrical printing blankets of the blanket cylinders. The inked images are then, in turn, transferred to opposite sides of the paper web.

Each plate cylinder has a corresponding inking system which delivers ink from an ink source (e.g., an ink reservoir or pump system) to the plate cylinder via a train of alternating hard and soft rollers at least some of which vibrate. Each plate cylinder also has a corresponding dampening system which delivers dampening solution from a source (e.g., a dampening reservoir or spray bar) to the plate cylinder also via a train of alternating hard and soft rollers at least some of which vibrate. The inking and dampening system rollers are in general tandem rolling contact with each other and ultimately, at their ends, with the plate cylinders. They are relatively fixed and immovable during normal use of the press.

Each of the blanket and plate cylinders is mounted between a pair of side frames defining the printing units. Each of the cylinders have tapered journals which are mounted in tapered bearings. The bearings are defined by an inner ring or "inner race" as it is also called, and an outer ring or "outer race". A plurality of anti-friction bearing rollers are disposed between the inner and outer races. The bearings permit the cylinders to rotate relative to the side frames. The outer race is disposed within a bearing sleeve which has an eccentric shape. As the bearing sleeves are rotated they cause the cylinder mounted within them to move laterally away from adjacent cylinders. A complicated mechanism including linkages and hydraulic cylinders is used to rotate the bearing sleeves and thus disengage the cylinders from one another.

During normal operation of the press, the cylindrical printing blankets must be periodically removed from the surface of the blanket cylinders. This is typically done when the cylindrical printing blankets become worn or damaged. To remove the printing blankets, the blanket cylinders must be disengaged with one another and with their corresponding plate cylinders. This operation of moving the blanket cylinders out of engagement with one another and the plate cylinders is known as "throwing off" the cylinders, and the position in which the cylinders are disengaged is known as the "throw off" position. In the throw off position, the cylinders are typically not separated from one another more than between 0.0625 to 0.125 inches.

The printing plates may also be removed and replaced when the cylinders are placed in the throw off position. Furthermore, a throw off gap is needed to provide space for the web to wrap and accumulate around one of the pair of blanket cylinders should it break during printing, thereby preventing possible damage to the blanket cylinders.

Known mechanisms for placing the cylinders in a throw off position typically include a drive linkage pivotally connected to a peripheral arm of the eccentric bearing sleeve which mounts the axle of one of the pair of blanket cylinders, and an interconnecting member pivotally linking together another peripheral arm of the eccentric bearing sleeve with a peripheral arm of another like eccentric bearing sleeve mounting the rotary axle of the other blanket cylinder. The eccentric bearing sleeves are mounted for rotation about fixedly mounted axes which are offset from the rotary axes of the blanket cylinders.

In order to place the cylinders in the throw off position when the printing press is non-operational, the drive linkage is moved by hydraulic cylinders which rotates the eccentric bearing sleeves in a counterclockwise direction from the operational position. This counterclockwise rotation causes the blanket cylinders to move away from the plate cylinders and away from each other to create the necessary throw off gap between the blanket cylinders and the pair of gaps between the pair of blanket cylinders and corresponding plate cylinders.

For press designs requiring very large gaps between the blanket cylinders and the corresponding plate cylinders in the throw off position it becomes necessary to reverse the eccentric center location. At the same time, in such presses the eccentricity must be made to be quite large, almost one inch (1.0"). This in turn causes the blanket cylinder bores to be very close together, thus minimizing the support surface from the side frames and hence minimizing the structural integrity of the system. Using conventional approaches of standard taper roller bearing assemblies within an eccentric bearing sleeve cannot be utilized without making the cross-section in the bearing sleeves very thin. Enlarging the bores to make larger bearing eccentric bearing sleeves also is not practical since for normal paper cut-off ranging from 13.688 inches to 15.000 inches the bores would almost intersect. In a compact press design, such as a tower unit with an integrated inverted next level, it also becomes difficult to provide adequate room for conventional mechanisms that will articulate the eccentric bearing sleeves and bearings into the throw off position. Furthermore, the bearing assemblies must be easy to mount and dismount from the printing cylinder journals and have a means of establishing proper preload as in the case of tapered roller bearings, as properly preloaded bearings will attain longest running life at the greatest load without any internal play.

The present invention is directed to a throw off mechanism which overcomes, or at least minimizes, some of these problems.

SUMMARY OF THE INVENTION

In accordance with one aspect of the present invention, a throw off device for disengaging adjacent blanket cylinders from each other and corresponding adjacent plate cylinders is provided. The device includes a pair of bearing assemblies that are mounted on the opposite ends of the journal of each of the blanket cylinders. The journal of each of the blanket cylinders is taper shaped. Each bearing assembly is defined by an inner race and an outer race having an eccentric bore in which the inner race is disposed. The inner race is defined by an inner ring and an outer ring. Each ring has a tapered-shaped inner surface which coincides with the tapered shape of the journal. A plurality of anti-friction elements, e.g., a plurality of pairs of tapered shaped roller bearings, are mounted to the inner race and disposed between the inner race and the outer race. These anti-friction elements allow the blanket cylinders to rotate relative to the outer races.

Each bearing assembly has a lever arm that is mounted to the outer race. The lever arm is defined by two wing-shaped portions. Each bearing assembly further includes a hydraulic cylinder. Each hydraulic cylinder is coupled at one end to one of the two wing-shaped portions of the lever arm and at the other end to one of the side frames of the printing press. A stopping member is mounted to the other wing-shaped portion of the lever arm. Each bearing assembly also has a corresponding adjustable stopping screw that is mounted to the side frame adjacent to the stopping member.

In accordance with another aspect of the present invention, a plumbing circuit is provided that uniformly supplies each of the hydraulic cylinders with hydraulic fluid so that they disengage the blanket cylinders in tandem. The plumbing circuit includes a control system for controlling the flow of the hydraulic fluid through the circuit. A directional valve is also provided to change the direction of the hydraulic fluid flowing into and out of the hydraulic cylinders in response to commands from the control system. The direction of fluid flow is dependent on whether the throw off device is in the engaged or the disengaged mode of operation. Flow dividers are also provided for directing equal volumes of hydraulic fluid into each of the hydraulic cylinders so that the hydraulic cylinders engage and disengage the blanket cylinders in tandem. One flow divider is provided for dividing the flow of the hydraulic fluid between each side of the printing press. Two other flow dividers are provided to divide the flow between adjacent hydraulic cylinders, one is provided for each side of the printing press.

BRIEF DESCRIPTION OF THE DRAWINGS

Other aspects and advantages of the present invention will become apparent upon reading the following detailed description and upon reference to the drawings in which.

DETAILED DESCRIPTION OF THE PREFERRED EMBODIMENTS

Figure 1:
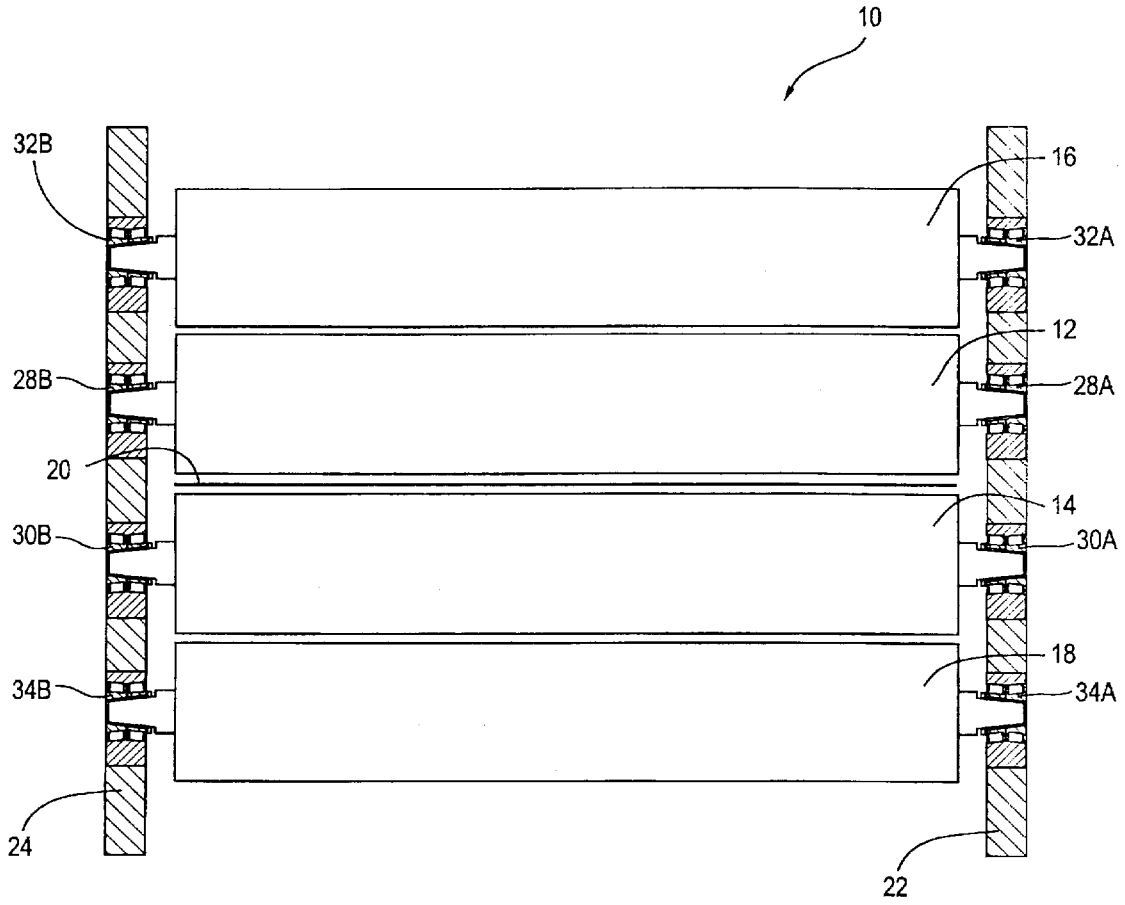
FIG. 1 is a schematic diagram of a printing unit incorporating improved bearing assemblies used in the throw off device according to the present invention.

Turning now to the drawings and referring initially to FIG. 1, a printing unit 10 incorporating an improved throw off device according to the present invention is shown. The printing unit 10 includes a pair of abutting blanket cylinders 12 and 14 and a pair of corresponding plate cylinders 16 and 18. Each of the blanket cylinders 12 and 14 carry a cylindrical printing blanket (not shown) and each of the plate cylinders 16 and 18 carry a corresponding printing plate (not shown). The blanket cylinders 12 and 14 transfer the inked image from printing plates on the plate cylinders 16 and 18 to a web of paper 20 passing between the abutting blanket cylinders 12 and 14.

Both the blanket cylinders 12 and 14 and the plate cylinders 16 and 18 are mounted between two parallel side frames 22 and 24 of the printing unit 10. The side frame 22 is on what is known as the operating side of the printing press and the side frame 24 is on what is known as the gear side of the printing press. The operating side of the printing press is where all the controls are located. It is also the side of the printing press where the press operators gain access to the blanket cylinders 12 and 14 and the plate cylinders 16 and 18. The gear side of the printing press is the side of the printing press where the drive gears for driving the printing press are located.

Figure 2:
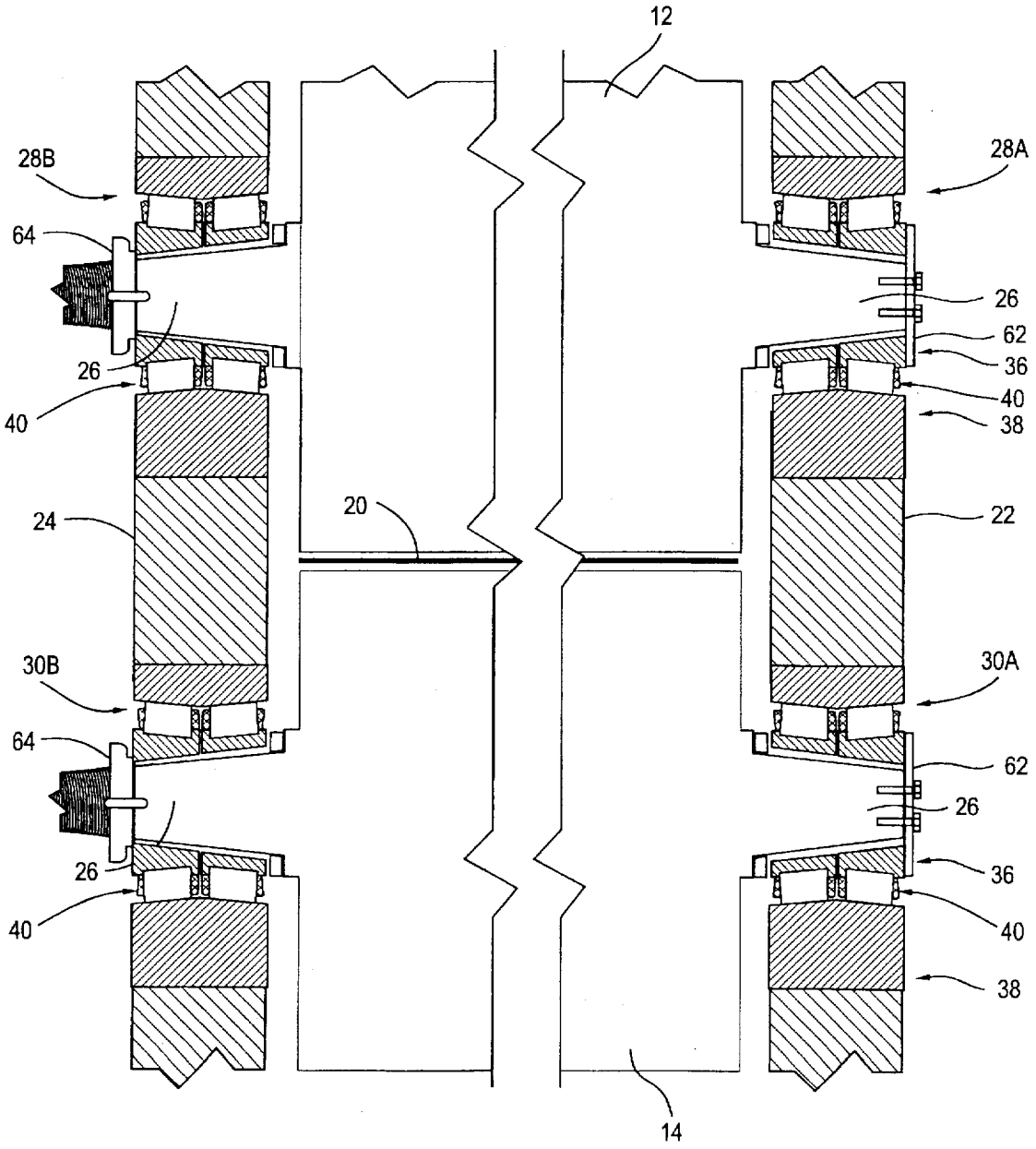
FIG. 2 is a an enlarged view of a pair of blanket cylinders incorporating the improved bearing assemblies shown in FIG. 1.

Each cylinder has a separate journal or shaft 26 which is mounted to the side frames 22 and 24, as shown in FIG. 2. The journals 26 are tapered at their ends where they are mounted within the side frames 22 and 24. More precisely, the ends of the journals 26 of the blanket cylinders 12 and 14 are mounted in bearing assemblies 28A, 28B, 30A and 30B which in turn are mounted within the side frames 22 and 24, as shown in FIGS. 1 and 2. The ends of the journals 26 of the plate cylinders 16 and 18 are mounted in bearing assemblies 32A, 32B, 34A and 34B which in turn are also mounted within the side frames 22 and 24, as shown in FIG. 1.

Figure 2A:
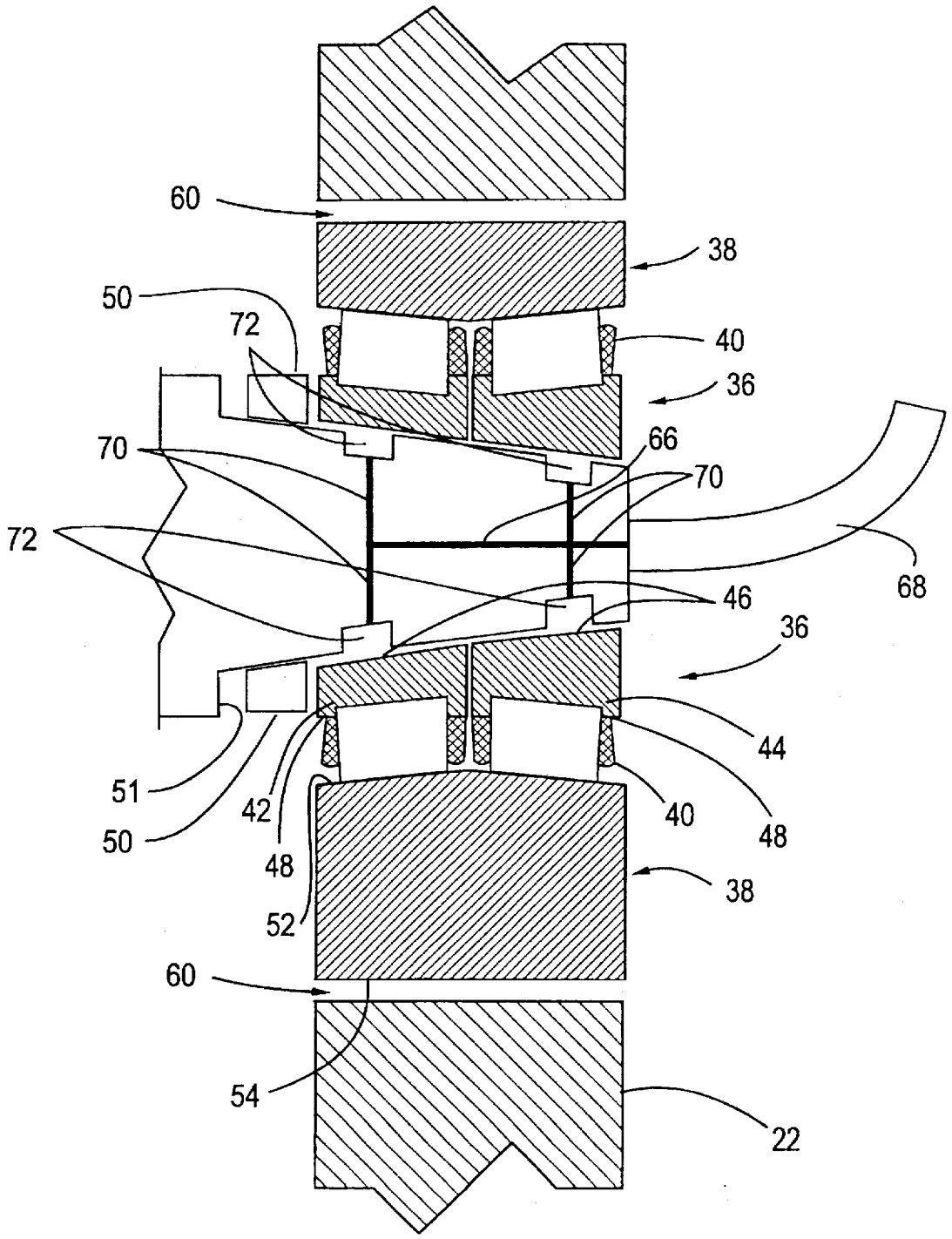
FIG. 2A is an enlarged view of a bearing assembly mounted on a cylinder journal according to the present invention.

Each of the bearing assemblies 28A, 28B, 30A and 30B supporting the blanket cylinders 12 and 14, respectively, is defined by an inner race 36 and an outer race 38, as shown in FIGS. 2 and 2A. A plurality of anti-friction roller elements 40 are mounted to the inner race 36 and disposed between the inner race 36 and the outer race 38.

Figure 3:
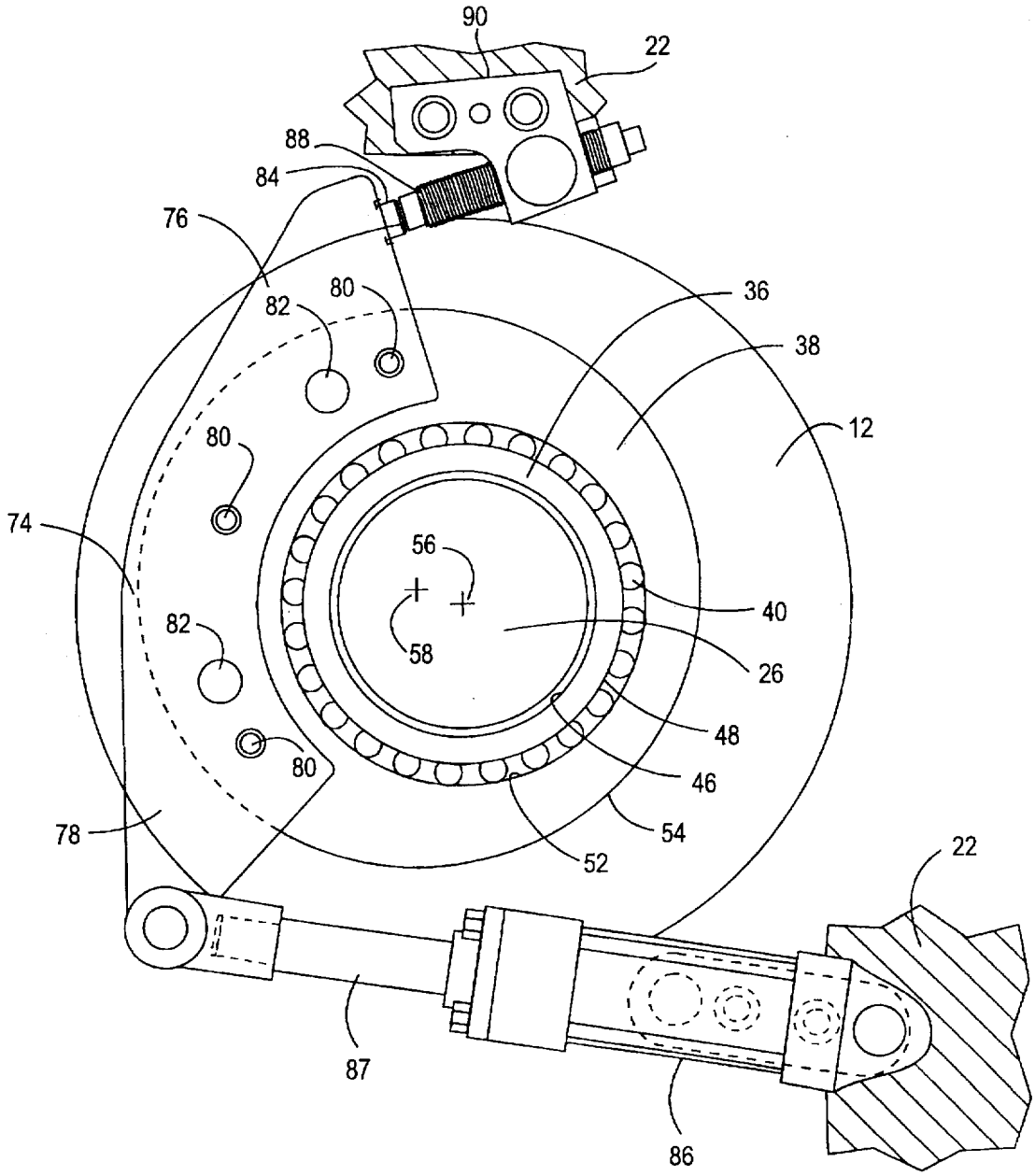
FIG. 3 is a side view of part of the throw off device according to the present invention.

The inner race 36 is defined by two rings, an inner ring 42 and an outer ring 44, as shown in FIG. 2A. Both the inner ring 42 and the outer ring 44 have a tapered-shaped inner surface 46 which coincides with the tapered shape of the journals 26 and a generally cylindrically-shaped outer surface 48, as shown in FIGS. 2A and 3. The tapered-shaped inner surfaces 46 of the inner and outer rings 42 and 44 of the inner race 36 matches the tapered-shape of the journal end mounted within the inner race. A ring 50 known as a ground spacer is disposed on the outer surface of the journal 26 between the inner ring 42 and the shoulder 51 of the cylinder, as shown in FIG. 2A. As discussed below, the ground spacers 50 are used in mounting the bearing assemblies 28A, 28B, 30A and 30B to the journals 26.

The outer race 38 is defined by a gradually inwardly tapered-shaped inner surface 52 and a generally cylindrically-shaped outer surface 54. The cylinders forming the outer surface 48 of the inner race 36 and the inner surface 52 of the outer race 38 share a common centerline 56, as shown in FIG. 3. The cylinder forming the outer surface 54 of the outer race 38, however, has a separate centerline 58. The centerlines 56 and 58 are parallel to one another but not coincident, so that the outer surface 48 of the inner race 36 is eccentric to the outer surface 54 of the outer race 38, as shown in FIG. 3. The outer races 38 fit within generally cylindrical bores 60 in the side frames 22 and 24, as shown in FIG. 2A.

The bearing assemblies 28A, 28B, 30A and 30B of the blanket cylinders 12 and 14 are mounted onto the tapered journals 26 using a hydraulic ram unit known to those of ordinary skill in the art. Each bearing assembly is pushed up the journal until it comes to rest against the ground spacer 50 which is selected to have a predetermined thickness. The thickness of the ground spacer 50 is determined using a mathematical algorithm employing the angle of the journal taper and its effect on the diametrical expansion of the inner races 36, and thus their effect on the preloading of the bearing rollers. This preload is measured as a value of rotational resistance or torque.

The final step in mounting the bearing assemblies 28A, 28B, 30A and 30B to the journals 26 involves locking the bearing assemblies onto the journals. This step is accomplished in two different ways for each side of the printing press. On the operating side of the printing press, the bearing assemblies 28A and 30A are locked on the journal ends with end plates 62 which are bolted to the ends of the journals. On the gear side of the printing press, the bearing assemblies 28B and 30B are locked onto the journal ends with locking nuts 64 which are screwed onto the ends of the journals 26. On the gear side of the printing press, the ends of the journals 26 are threaded to allow the locking nuts 64 to be screwed onto the journals.

The bearing assemblies 28A, 28B, 30A and 30B of the blanket cylinders 12 and 14 are dismounted as follows. First, hydraulic fluid is pumped into channels 66 (shown in FIG. 2A) drilled into the ends of journals 26 via hoses 68. The channels 66 deliver the hydraulic fluid under pressure to exit ports 70 which feed into external grooves 72 that are disposed around the outer circumference of the journals 26 adjacent to the inner races 36. The hydraulic fluid under pressure exerts a force on the inside diameter of the inner races 36 causing enough diametrical expansion of the inner races 36 to cause the bearing assemblies 28A, 28B, 30A, and 30B to slide off the journals 26.

The bearing assemblies 32A, 32B, 34A and 34B supporting the plate cylinders 16 and 18 are of conventional design and are mounted and dismounted on their respective journals using conventional techniques.

During operation of the printing press, the inner races 36 rotate relative to the outer races 38 as the blanket cylinders 12 and 14 whose journals 26 are mounted within the inner races 36 rotate relative to the fixed side frames 22 and 24. This relative rotational movement is accomplished by the plurality of anti-friction roller elements 40. As those of ordinary skill in the art will appreciate, any anti-friction roller elements may be used. Examples of such anti-friction rolling elements include: cylindrical roller bearings, tapered roller bearings, and ball bearings. Tapered roller bearings are shown in the drawings and are preferred.

During operation of the printing press, the outer races 38 remain stationary. They are mounted to the side frames 22 and 24 and do not rotate during operation of the press. However, the outer races 38 are capable of rotating relative to the side frames 22 and 24. The outer races 38 are rotated to place the blanket cylinders 12 and 14 in a throw off position. Since the journals 26 of the blanket cylinders 12 and 14 are mounted within the inner races 36 which are eccentric to the outer races 38, as the outer races 38 are rotated relative to the side frames 22 and 24, the blanket cylinders 12 and 14 are moved laterally away from one another thus creating gaps between the cylinders which enable worn or damaged printing blankets and/or printing plates to be removed and replaced.

The improved throw off device according to the present invention thus includes the eccentric bearing assembly pairs 28A, 28B, 30A and 30B. An advantage of these eccentric bearing assembly pairs is that they eliminate the need for eccentric bearing sleeves and thus make the overall design of the printing press simpler and cheaper. Furthermore, by eliminating the bearing sleeves, the eccentric offset can be made larger to create larger gaps between the blanket cylinders 12 and 14 and the plate cylinders 16 and 18 in the throw off position if more working space is desired.

The throw off device according to the present invention further includes a lever arm 74 (shown in FIG. 3) which is mounted to each of the bearing assemblies 28A, 28B, 30A and 30B. The lever arm 74 is arc-shaped and is defined by two wing-shaped portions 76 and 78. The lever arm 74 is preferably attached to the outer race 38 with three screws 80, two of which are disposed at opposite ends of the plate and one in the middle, and two dowel pins 82 disposed adjacent the two screws disposed at the opposite ends of the plate, as shown in FIG. 3. The arc of the lever arm 74 is preferably an obtuse angle. A stopping member 84 is mounted on the wing-shaped portion 76 which limits the angle through which the outer race 38 may be rotated, as further explained below. The lever arm 74 is preferably formed of steel and is approximately 1.0 inches thick.

A hydraulic cylinder 86 is attached to each lever arm 74, as shown in FIG. 3. At one end, the hydraulic cylinder 86 is attached to the wing-shaped portion 78 of the lever arm 74 and at the other it is attached to the side frame 22, as shown in FIG. 3. As those of ordinary skill in the art will understand, hydraulic cylinders 86 are provided for each bearing assembly in the bearing assembly pairs 28A, 28B, 30A and 30B.

Figure 4:
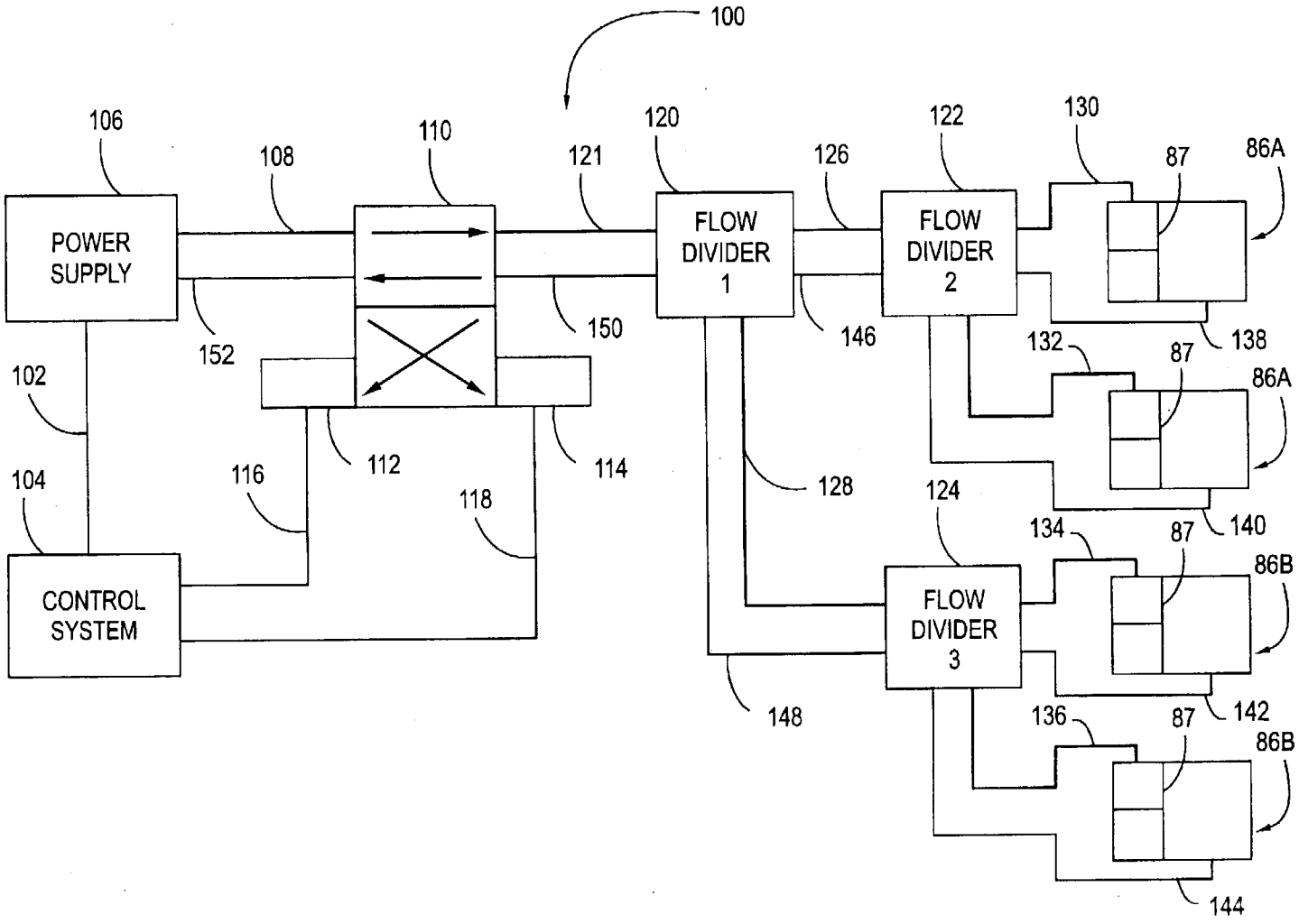
FIG. 4 is a block diagram of a plumbing circuit used to control the positions of the hydraulic cylinders used in the throw off device according to the present invention.

The hydraulic cylinders 86 are supplied with hydraulic fluid through a plumbing circuit indicated generally by reference numeral 100, as shown in FIG. 4. Although each of the hydraulic cylinders 86 is independent in the sense that none of the eccentric bearing assemblies are linked together by an interconnecting pivoting member, they are supplied by the same source of hydraulic fluid. The plumbing circuit 100 shown in FIG. 4 supplies each of the hydraulic cylinders 86 with the same volume of hydraulic fluid at the same pressure so that the lever arms 74 rotate in tandem to achieve a uniform separation of the blanket cylinders 12 and 14 away from each other and their corresponding plate cylinders 16 and 18.

The plumbing circuit 100 operates as follows. In response to a signal via communication line 102, control system 104, which may be a PC (i.e., a personal computer) based system, activates power supply 106 to supply hydraulic fluid under pressure via fluid line 108 to directional valve 110. Directional valve 110 controls the direction of the hydraulic fluid flowing through the circuit 100 by the use of a pair of solenoids 112 and 114. The directional valve 110 and the solenoids 112 and 114 are well known devices and therefore are not described further herein. The solenoids 112 and 114 are in turn controlled by control system 104 via communication lines 116 and 118, respectively.

After the hydraulic fluid passes through the directional valve 110 it is delivered to a flow divider 120 via fluid line 121. The flow divider 120 divides the flow of the hydraulic fluid into two paths. One path delivers the hydraulic fluid to the operating side of the press and the other path delivers the hydraulic fluid to the gear side of the press. The flow divider 120 acts as a hydraulic equalizer dividing the volume equally between each path. It is a passive device in that it is not controlled electrically. It uses a spring and diaphragm (not shown). Flow dividers are known to those of ordinary skill in the art and therefore will not be described further herein.

After the hydraulic fluid passes through flow divider 120 it is delivered to flow dividers 122 and 124 via fluid lines 126 and 128, respectively. The flow divider 122 in turn routes the flow of the hydraulic fluid via fluid lines 130 and 132 to the hydraulic cylinders 86A, which are disposed on one side of the printing press, e.g., the operating side of the press. The flow divider 124 in turn routes the flow of the hydraulic fluid via fluid lines 134 and 136 to the hydraulic cylinders 86B which are disposed on the other side of the printing press, e.g. , the gear side of the press. The hydraulic fluid is delivered under pressure via the fluid lines 130–136 to the left chamber of the hydraulic cylinders 86A and 86B, as shown in FIG. 4. As fluid is delivered to the left chambers of the hydraulic cylinders 86A and 86B, it is simultaneously removed from the right chambers of the hydraulic cylinders. The hydraulic fluid exits the right chambers of the hydraulic cylinders via fluid lines 138, 140, 142 and 144. The hydraulic fluid is communicated via fluid lines 138 and 140 to flow divider 122 and via fluid lines 142 and 144 to flow divider 124. From the flow dividers 122 and 124, the fluid returns to flow divider 120 via fluid lines 146 and 148, respectively. The fluid is then pumped to the directional valve 110 via fluid line 150 and then back to the power supply 106 via fluid line 152.

As the hydraulic fluid is pumped through the system in the above described direction, pistons 87 within the hydraulic cylinders 86 (86A and 86B) are forced to the right thus causing the cylinders to extend into the extended position. The direction of the flow of the hydraulic fluid may be switched by reversing the direction of the directional valve 110. This is accomplished by activating the solenoids 112 and 114 which are controlled by the control system 104 via communication lines 116 and 118. In the reverse direction, the hydraulic fluid is emptied from the left chambers of the hydraulic cylinders 86A and 86B and supplied to the right chambers. In response to the emptying of the left chambers and the filling of the right, the pistons 87 are forced to the left thus causing the cylinders to retract into the retracted position. As will be described further below, when the pistons 87 are in the extended position, the blanket cylinders 12 and 14 are placed in the engaged position and when they are in the retracted position, the blanket cylinders are in the disengaged position. The stroke of the hydraulic cylinders 86 is approximately between 2.0 and 3.0 inches.

The flow dividers 120, 122 and 124 regulate the volume of hydraulic fluid flowing into and out of the hydraulic cylinders 86 so that the exact same volume is delivered to each of the chambers of the cylinders at the same time thus ensuring uniform extension and retraction of the pistons 87. This in turn causes the blanket cylinders 12 and 14 to be engaged and disengaged with one another and with the corresponding plate cylinder 16 and 18 in tandem. Because the hydraulic cylinders 86 can be operated independently with such precision, the bearing assembly pairs 28A and 28B, and 30A and 30B need not be linked together by an interconnecting member as with the bearing sleeves of the prior art devices.

Returning to FIG. 3, an adjustable stopping screw 88 is also provided which cooperates with the stopping member 84 to limit the rotational movement of the outer race 38. The adjustable stopping screw 88 is mounted to the side frame 22 with a bracket 90. The stopping member 84 engages the adjustable stopping screw 88 as the lever arm 74 is rotated by the action of the hydraulic cylinder 86. The gap size between the cylinders in the engaged position can be adjusted by adjusting the position of the stopping screw 88. The pressure between the cylinders in the engaged position can be adjusted by adjusting the position of the stopping screw 88. The stopping screw 88 is preferably adjusted so that the stopping member 84 engages the stopping screw when the blanket cylinders 12 and 14 have come together with the corresponding plate cylinders 16 and 18 the desired distance. As those of ordinary skill in the art will appreciate, other adjustable stopping mechanisms may be provided in place of the stopping member 84/stopping screw 88 pair.

Figure 5A:
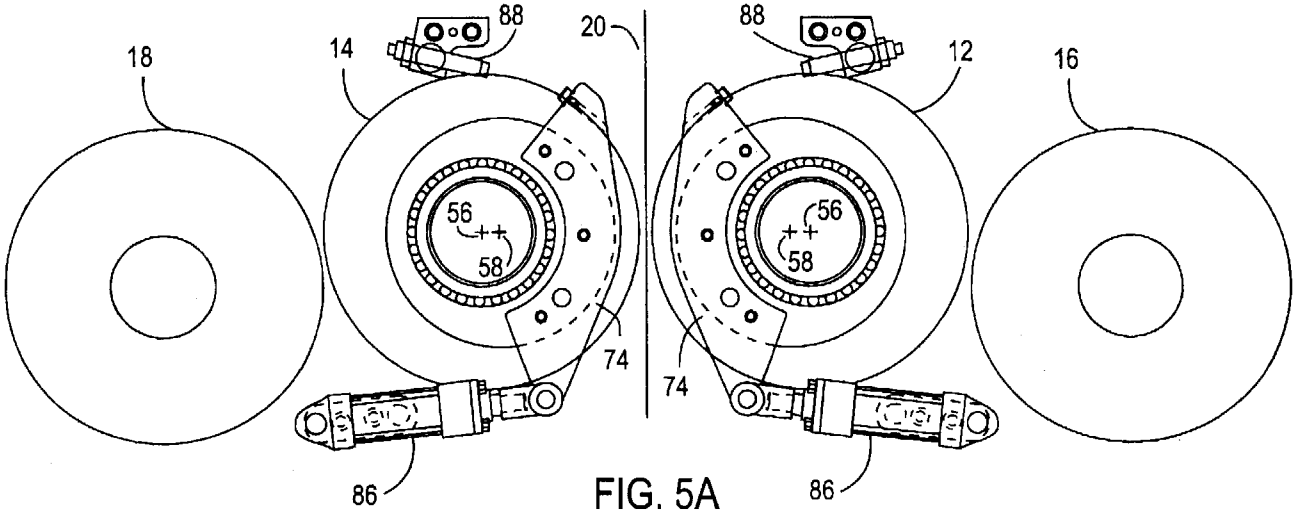
FIG. 5A is a schematic diagram of a throw off device according to the present invention in the disengaged position.
Figure 5B:
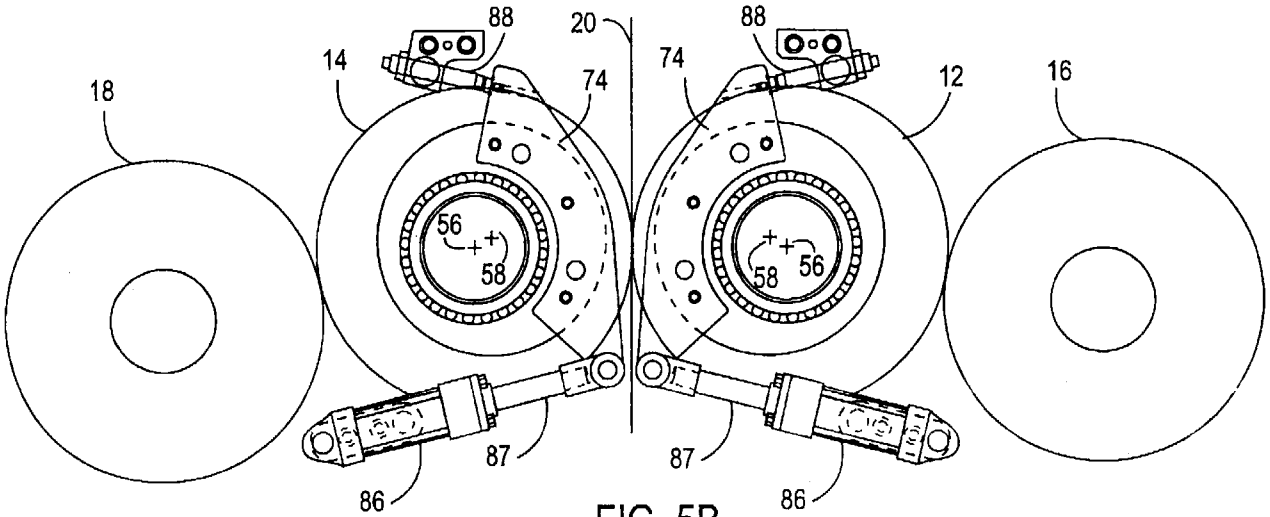
FIG. 5B is a schematic diagram of a throw off device according to the present invention in the engaged position.

The operation of the throw off device according to the present invention is best explained by reference to FIGS. 5A and 5B. During operation of the printing press, the hydraulic cylinders 86 are in the extended or engaged position, as shown in FIG. 5B. In this position, the blanket cylinders 12 and 14 are engaged with each other and with the corresponding adjacent plate cylinders 16 and 18. A gap gauge (not shown) can be used to ensure that adequate pressure is maintained between the cylinders. The pressure between the cylinders must be precisely maintained to ensure that the printed image is completely transferred from the printing plates to the web of paper 20. If the pressure is too low a complete image will not be transferred, and if the pressure is too high the image will smear. The adjustment of cylinder pressure is well known and therefore will not be discussed further herein.

When it is desired to remove a printing blanket or printing plate, the throw off device according to the present invention is activated. Upon activation, the pumping circuit 100 is controlled to supply the hydraulic cylinders 86 right with hydraulic fluid as described above. As hydraulic fluid is pumped into the right chambers of the hydraulic cylinders 86 and out of the left chambers, the pistons 87 of the hydraulic cylinders are pushed inward and thus are retracted causing the lever arms 74 to pivot about centerline 58. As the lever arms 74 pivot, the outer races 38 rotate about their centerlines 58 which in turn causes the inner races 36 to revolve around centerlines 58. As the inner races 36 revolve around centerlines 58 they carry the journals 26 of the blanket cylinders 12 and 14. This rotational movement causes the blanket cylinders 12 and 14 to move laterally away from each other and the corresponding plate cylinders 16 and 18. Referring to FIG. 5A, the blanket cylinder 12 is disengaged from the blanket cylinder 14 and the plate cylinder 16. Similarly, the blanket cylinder 14 is disengaged from the blanket cylinder 12 and the plate cylinder 18.

The lever arms 74 are pivoted about the centerlines 58 until the hydraulic cylinders are fully retracted, at which point the cylinders 12, 14, 16 and 18 have reached the desired throw off position. Each blanket cylinder preferably moves away from the adjacent blanket cylinder approximately 0.050 inches for a total blanket-to-blanket separation of 0.10 inches and from its adjacent plate cylinder approximately 0.030 inches.

Those skilled in the art who now have the benefit of the present disclosure will appreciate that the present invention may take many forms and embodiments. Some embodiments have been described so as to give an understanding of the invention. It is intended that these embodiments should be illustrative, and not limiting of the present invention. Rather, it is intended that the invention cover all modifications, equivalents and alternatives falling within the spirit and scope of the invention as defined by the appended claims.

What is claimed is:

1. An offset printing press having an apparatus for engaging and disengaging adjacent blanket cylinders from each other and corresponding adjacent plate cylinders, each of the cylinders having a tapered-shaped journal that is mounted between two parallel side frames of the printing press, the apparatus comprising:

at least one pair of bearing assemblies mounted on opposite ends of the tapered-shaped journal of at least one of the blanket cylinders, wherein each of the bearing assemblies is defined by an outer race mounted within a bore in one of the parallel side frames so as to be in a fixed position during operation of the printing press, the outer race of each of the bearing assemblies having an eccentric bore, and wherein each of the bearing assemblies is defined by an inner race disposed within the eccentric bore in the corresponding outer race so as to be movable during operation of the printing press, the outer race of each of the bearing assemblies thereby supporting the opposite ends of tapered-shaped journal within the two parallel side frames of the printing press, and wherein each of the bearing assemblies is defined by at least one anti-friction element disposed between the inner race and outer race to facilitate movement of the inner race relative to the outer race during operation of the printing press, the inner race being defined by an inner ting, an outer ring, and a ground spacer disposed between the inner ring and a shoulder of the cylinder, and wherein each of the inner and outer rings has a tapered-shaped inner surface and a cylindrically-shaped outer surface.

2. The apparatus according to claim 1, further comprising a lever arm corresponding to each bearing assembly, said lever arm being mounted to the outer race of each of the bearing assemblies and being defined by two wing-shaped portions.

3. The apparatus according to claim 2, further comprising a hydraulic cylinder corresponding to each bearing assembly, said hydraulic cylinder being coupled at one end to one of the two wing-shaped portions of the lever arm and at the other end to the side frame.

4. The apparatus according to claim 3, wherein a stopping member is mounted to the other of the two wing-shaped portions of the lever arm.

5. The apparatus according to claim 4, further comprising an adjustable stopping screw corresponding to each bearing assembly, said adjustable stopping screw being mounted to the side frame adjacent to the stopping member and limiting the rotational movement of the lever arm.

6. The apparatus according to claim 1, wherein the at least one anti-friction element includes a plurality of pairs of tapered roller bearings.

7. An offset printing press having an apparatus for engaging and disengaging adjacent blanket cylinders from each other and corresponding adjacent plate cylinders, each of the cylinders having a tapered-shaped journal that is mounted between two parallel side frames of the printing press, the apparatus comprising:

at least one pair of bearing assemblies mounted on opposite ends of the tapered-shaped journal of at least one of the blanket cylinders, wherein each of the bearing assemblies is defined by an outer race mounted within a bore in one of the parallel side frames so as to be in a fixed position during operation of the printing press, the outer race of each of the bearing assemblies having an eccentric bore, and wherein each of the bearing assemblies is defined by an inner race disposed within the eccentric bore in the corresponding outer race so as to be movable during operation of the printing press, the outer race of each of the bearing assemblies thereby supporting the opposite ends of the tapered-shaped journal within the parallel side frames of the printing press, and wherein each of the bearing assemblies is defined by at least one anti-friction element disposed between the inner race and the outer race to facilitate movement of the inner race relative to the outer race during operation of the printing press, the inner race being defined by an inner ting and an outer ring each having a tapered-shaped inner surface and a cylindrically-shaped outer surface, a hydraulic cylinder coupled to each bearing assembly, and a plumbing circuit for supplying the hydraulic cylinders with hydraulic fluid, the plumbing circuit comprising a control system for controlling the flow of the hydraulic fluid through the circuit, a directional valve that changes the direction of the hydraulic fluid flowing into and out of the hydraulic cylinders in response to commands from the control system and at least one flow divider that directs equal volumes of hydraulic fluid into each of the hydraulic cylinders so that the hydraulic cylinders engage and disengage the blanket cylinders in tandem.

8. The apparatus according to claim 7, wherein each blanket cylinder has a corresponding pair of bearing assemblies and the plumbing circuit comprises three flow dividers, one for dividing the flow of the hydraulic fluid between each side of the printing press, and two for dividing the flow between adjacent hydraulic cylinders, one for each side of the printing press.

* * * * *

UNITED STATES PATENT AND TRADEMARK OFFICE

CERTIFICATE OF CORRECTION

PATENT NO. : 5,722,323

DATED : March 3, 1998

INVENTOR(S) : Whiting et al.

It is certified that error appears in the above-identified patent and that said Letters Patent is hereby corrected as shown below:

Column 9, line 27, delete "ting" and insert in its place --ring--; and

Column 10, line 28, delete "ting" and insert in its place --ring--.

Signed and Sealed this

Nineteenth Day of January, 1999

*Attest:*

*Attesting Officer*

*Acting Commissioner of Patents and Trademarks*